US009208730B2

(12) United States Patent
Botzas

(10) Patent No.: US 9,208,730 B2
(45) Date of Patent: Dec. 8, 2015

(54) OPTIMIZATION OF LIGHT SOURCE DRIVE VALUES IN BACKLIGHT SYSTEMS

(75) Inventor: Anthony Botzas, San Jose, CA (US)

(73) Assignee: Samsung Display Co., Ltd. (KR)

( * ) Notice: Subject to any disclaimer, the term of this patent is extended or adjusted under 35 U.S.C. 154(b) by 203 days.

(21) Appl. No.: 13/107,745

(22) Filed: May 13, 2011

(65) Prior Publication Data

US 2012/0287182 A1 Nov. 15, 2012

(51) Int. Cl.
*G09G 3/34* (2006.01)

(52) U.S. Cl.
CPC ..... *G09G 3/3426* (2013.01); *G09G 3/342* (2013.01); *G09G 2360/16* (2013.01)

(58) Field of Classification Search
CPC ..... G09G 3/342; G09G 3/3426
USPC ..... 345/87–102
See application file for complete search history.

(56) References Cited

U.S. PATENT DOCUMENTS 5,815,641 A * 9/1998 Marshall ..... 358/1.8
2007/0002000 A1* 1/2007 Kwon ..... 345/102
2008/0278432 A1* 11/2008 Ohshima ..... 345/102
2009/0102783 A1* 4/2009 Hwang et al. ..... 345/102
2009/0184917 A1* 7/2009 Park et al. ..... 345/102
2011/0141154 A1* 6/2011 Ahn et al. ..... 345/690
2011/0193896 A1* 8/2011 Johnson ..... 345/690
2012/0075353 A1* 3/2012 Dong et al. ..... 345/690

* cited by examiner

*Primary Examiner* — Priyank Shah
*Assistant Examiner* — Chad Dicke
(74) *Attorney, Agent, or Firm* — Innovation Counsel LLP

(57) ABSTRACT

A method of optimizing the luminance level of a backlight system is presented. The method entails dividing the backlight system into zones, each of the zones having a light source; determining a target illumination level for each of the zones based on data values of a display panel that is to be illuminated by the backlight system; and setting a backlight drive value of the light source in a particular zone based on target illumination level of the particular zone and a backlight drive value assigned to its neighboring zone. The invention makes high-quality image display achievable with reduced power consumption by taking advantage of the "communal" aspect of the zones in a local dimming backlight system. In determining the backlight drive value of a zone, the invention takes into account the illumination contributions from neighboring zones.

9 Claims, 7 Drawing Sheets

OPTIMIZATION OF LIGHT SOURCE DRIVE VALUES IN BACKLIGHT SYSTEMS

FIELD OF INVENTION

This invention relates generally to a display system, and more particularly to a display system having a backlight.

BACKGROUND

Some display devices, such as liquid crystal displays (LCDs), often use a backlight as a light source to display an image. Typically, the backlight is on at a constant, preselected brightness level to illuminate the display panel. The brightness level of the backlight can be high or low. While a brighter backlight usually results in a higher image quality, it results in high power consumption. High power consumption is disadvantageous, especially for a portable display system that draws its power from a battery. Adjusting the backlight level to a lower brightness decreases power consumption but yields lower image quality, for example with noticeable visual artifacts in parts of the image that show bright, saturated colors.

Different techniques have been developed to optimize the backlight level by balancing the image quality concerns with the power conservation goals. One such technique involves dynamically adjusting the global backlight level as an image is displayed. However, the dynamic global backlight adjustment technique has room for improvement. For example, dynamic adjustment often results in a backlight level that is higher than what is needed to show a high-quality image, using more power than necessary.

A method of adjusting the backlight level in a power-efficient manner without compromising image quality is desired.

SUMMARY

In one aspect, the invention is a method of optimizing the luminance level of a backlight system. The method entails dividing the backlight system into zones, each of the zones having a light source; determining a target illumination level for each of the zones based on data values of a display panel that is to be illuminated by the backlight system; and setting a backlight drive value of the light source in a particular zone based on target illumination level of the particular zone and a backlight drive value assigned to its neighboring zone.

The invention makes high-quality image display achievable with reduced power consumption by taking advantage of the "communal" aspect of the zones in a local dimming backlight system. In determining the backlight drive value of a zone, the invention takes into account the illumination contributions from neighboring zones.

DETAILED DESCRIPTION

One way to improve power usage efficiency is to adjust the backlight level section-by-section instead of controlling the entire backlight with a single drive value. Sometimes referred to as "local dimming," this method allows parts of the image that does not need a bright backlight to operate with a lower backlight (thereby saving power) while the parts of the image that need bright backlight will still get bright backlight to display a high-quality image. Local dimming method entails dividing a backlight into multiple zones and controlling the brightness level of each zone with its own backlight drive value. The brightness level of each zone is controlled independently of other zones although, as will be described below, the brightness of neighboring zones will be taken into account in determining the brightness of a particular zone.

The backlight drive value of each of the zones may be selected on a frame-by-frame basis depending on the image that is being displayed. For example, if a dark cave scene is being displayed where an explorer in the cave discovers a bright yellow object, the zones that display the bright yellow object will be assigned a high backlight level while the other zones may be assigned a relatively low backlight level. With this type of localized backlight adjustment, it is possible to achieve optimum display quality at low power consumption.

Figure 1:
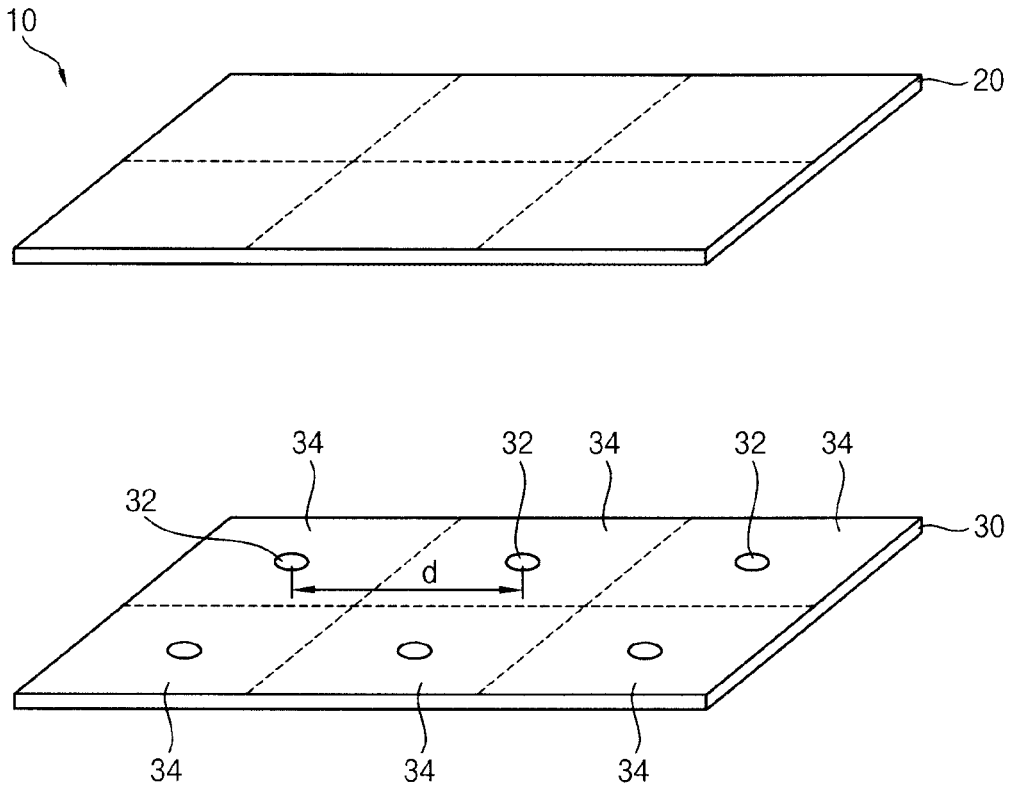
FIG. 1 illustrates a display system implementing local dimming.

FIG. 1 illustrates a display system 10 implementing local dimming. The display system 10 includes a display panel 20 (e.g., an LCD panel) and a backlight system 30 that provides light to the display panel 20. The backlight 30 is divided into multiple zones 34, each zone corresponding to a portion of the complete image that is being displayed on the display panel 20. Each zone has a set of light sources 32 that is controlled by a single backlight drive value. Each set of light source 32 is modulated according to the display panel data values so that an optimal backlight level is selected for each zone according to the image that is being displayed in that zone. Typically, a section of the display panel 20 that corresponds to a zone has multiple pixels.

Although the particular embodiment of FIG. 1 shows six zones, the invention is not limited to any particular number of zones. Similarly, the invention is not limited to any particular number or arrangement of the light sources 32. In the particular embodiment of FIG. 1, the light sources 32 are separated by a distance d such that zone boundaries intersect the d/2 point. While the light source 32 is depicted as a single light source for simplicity, it may include one light source 32 or a plurality of light sources 32 that are controlled by a single drive value. Although the invention will be described with the assumption that the light sources 32 are light emitting diodes (LEDs), CCFLs, or other known light-emitting devices may be used instead of LEDs.

Although an embodiment where each zone has one pixel or sub-pixel is contemplated, the invention will be described in the context of there being multiple pixels in a zone. The zones do not necessarily have to be equal in size, the number of pixels, or the number and configuration of the assigned light sources 32.

Figure 2A:
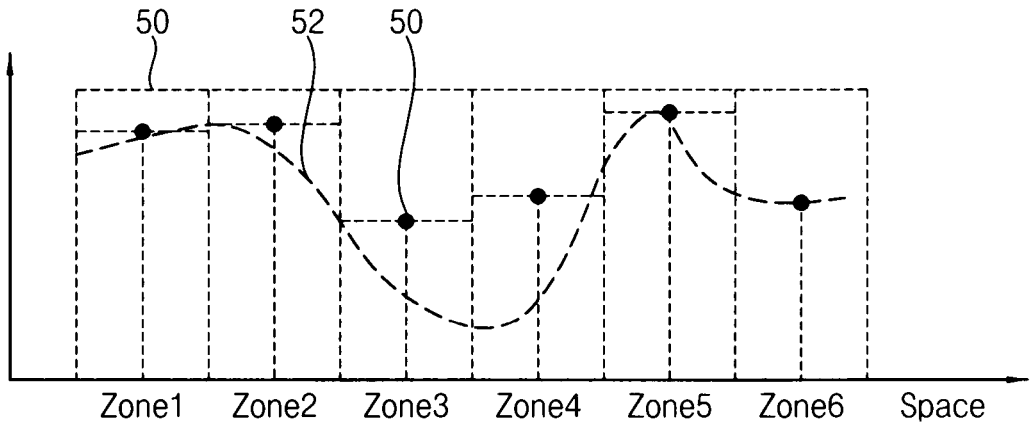
FIG. 2A illustrates a digital processing system where the backlight level in each zone is derived from the maximum channel value.

FIG. 2A illustrates a digital processing system where the backlight level in each zone is derived from the maximum channel value. As shown, each zone has a maximum channel value 50, which is the maximum backlight level that would be required to properly display the image corresponding to that zone. Usually, the maximum channel value depends on the backlight level required by the most-demanding pixel in that zone. The broken curve 52 that extends across the plot shows the backlight level across the zones that would display the image properly. As shown, setting the backlight drive value for each zone to maximum channel value can result in an effective backlight level that is higher than what is needed to produce a high-quality image.

Figure 2B:
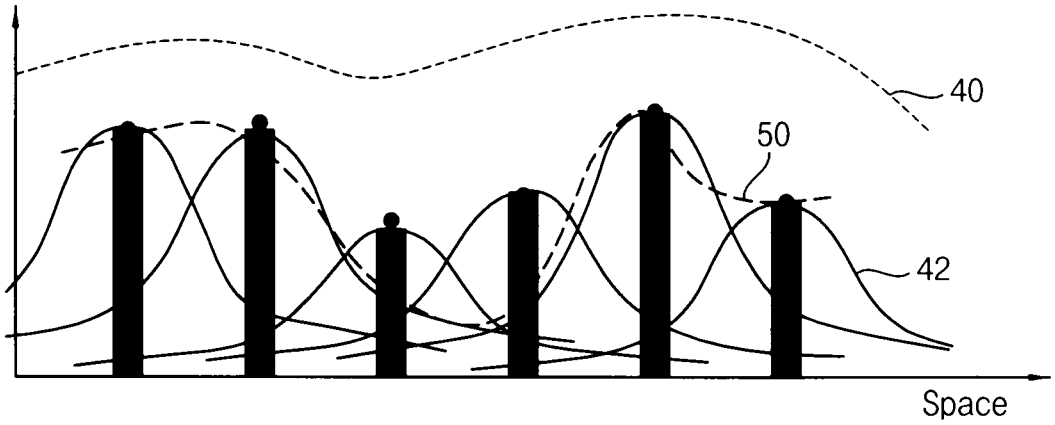
FIG. 2B illustrates the effective backlight level that results from the individual point-spread function of the backlights in each zone.

The reason for the backlight level ending up higher than needed is because light from a light source 32 spreads, illuminating not just its own display zone but also contributing to the illumination of the neighboring display zones. FIG. 2B shows the effective illumination level 40 that results from the individual point-spread function 42 of the backlights in each zone. Light from a light source 32 propagates such that it "spreads" with increasing distance from the source, resulting in a point spread function (PSF). When each zone is set to its maximum channel value and also receives "overflow" illumination from the backlights of the neighboring zones, the combined effect is a higher illumination level than what is needed.

The invention stems from a recognition that there is a "communal" aspect to local dimming stemming from the fact that light in each zone is not completely contained in that zone. Each zone receives light from its own light source 32 and also from neighboring zones that contribute to the luminance of the given zone. A "neighboring" zone includes but is not limited to an immediately adjacent zone. For example, depending on the size of the zones and the point spread function of the light sources 32, a zone that is multiple zones away can contribute to the illumination of a zone.

The invention includes a recursive technique for minimizing light source drive values in a display system that implements local dimming. The local backlight optimization process is based on a number of concurrent processes, the number equaling the total number of zones whose drive values are to be optimized. Each process keeps track of the total current backlight of all the spreading functions at one or more points in a given backlight zone. Each process also keeps track of the difference (A) between the current backlight illumination level and the target backlight illumination level.

Figure 3:
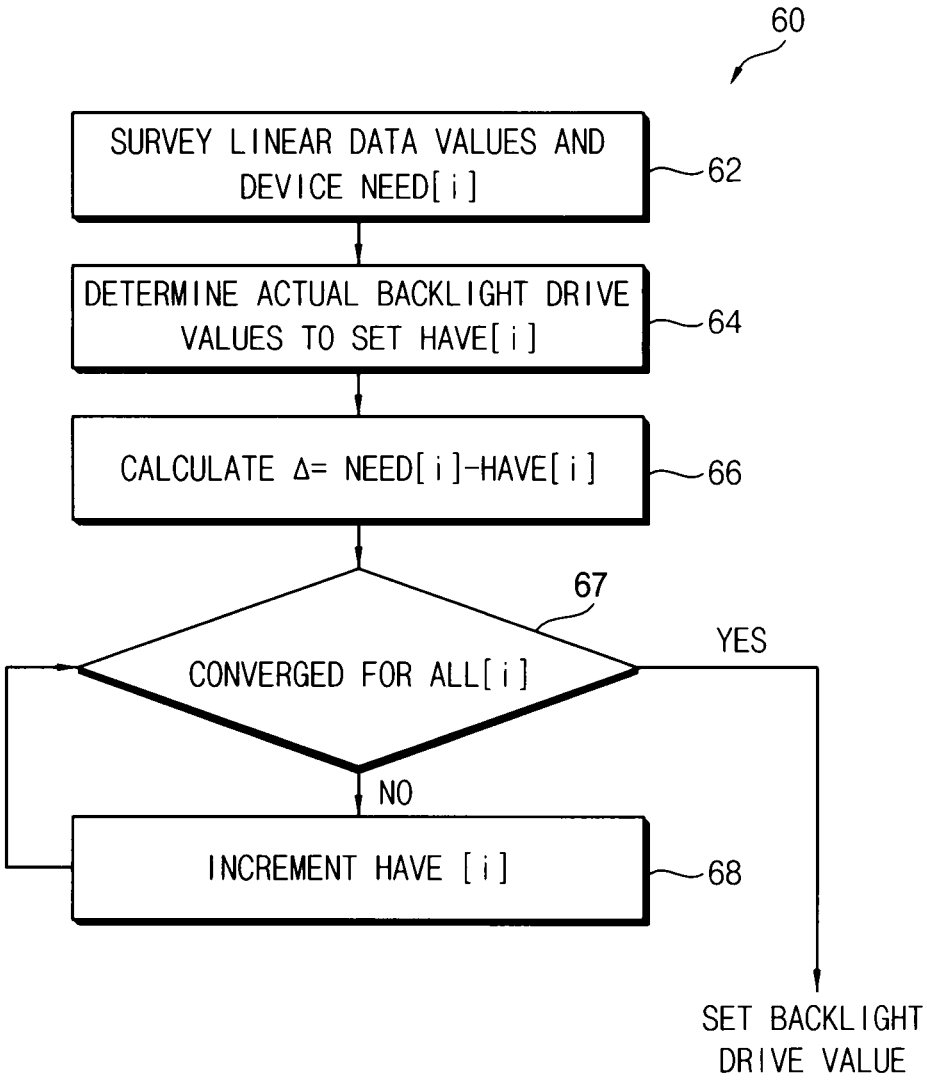
FIG. 3 depicts the local backlight optimization process in accordance with the invention.

FIG. 3 depicts the local backlight optimization process 60 in accordance with the invention. The optimization process 60 begins with a survey of linear data values that are fed to the display panel 20. During the survey, a determination is made as to what level of backlight illumination is requested or required by each pixel in a zone. Based on this determination, the required illumination level for each zone is derived, and set equal to need[i], "i" indicating a particular zone (step 62). In one embodiment, the peak channel value for each zone may be used as the required backlight level. In determining the need[i] value for a zone, most methods that are used for global dimming may be applied to each zone, by treating each zone as the entire backlight. For example, the histogram-based backlight level selection technique described in U.S. Patent Application Publication No. 2011/0025592 may be used to set the need[i] value for a zone.

The current illumination level at each zone is surveyed as well, and set to have[i] (step 64). The LEDs are characterized, and each LED drive value has a PSF associated with it. Hence, have[i] value may be determined through mathematical modeling based on the drive values.

The difference (A) between need[i] and have[i] is calculated (step 66) and checked for convergence (step 67). Depending on the implementation, the condition of "convergence," as used herein, may deemed to be satisfied if a preselected number of iterations have completed, if Δ is less than a preset amount, or if Δ keeps bouncing back between two values (e.g., +1 and −1). If the convergence condition is not satisfied, have[i] is incremented again (step 68) and the iterative process continues until the processes converge to optimum backlight drive values that meet or exceed the desired effective backlight targets for all the zones i.

An "incrementation," as used herein, may be done by a positive amount or a negative amount (i.e., it includes decrementation). Typically, if need[i]>have[i], the backlight drive value is incremented by a positive amount to get have[i] closer to need[i]. On the other hand, if need[i]<have[i], the backlight drive value is incremented by a negative amount. In addition, in making the decision in step 68, each zone takes into account the state that their neighboring zones are in. For example, a zone increments the backlight drive value if its neighboring zones have reached 100% of their drive values and have still not reached their target luminance (i.e., the neighbors are "exhausted"). Hence, even if the Δ value for that zone is already smaller than the preset value and its own needs are satisfied, its backlight drive value may still get incremented to help its neighbor(s). Each process for a zone "i" can consider the data values of all the other processes and independently make a decision as to whether to increment its associated backlight driving value up or down. In one embodiment, the values need[i] and have[i] are represented in nits or candelas.

Each incrementing of the value is usually done by a small preset magnitude. However, a multiplicative gain factor may also be used to increment the drive values up or down. Alternatively, the magnitude of the increment amount can be dynamically adjusted (instead of being a constant present amount) to speed up the rate of steady state convergence. Small increments are preferred when trying to minimize oscillatory behavior. Such small increment magnitudes can be thought of as high dampening factors on the recursive processes.

Figure 4:
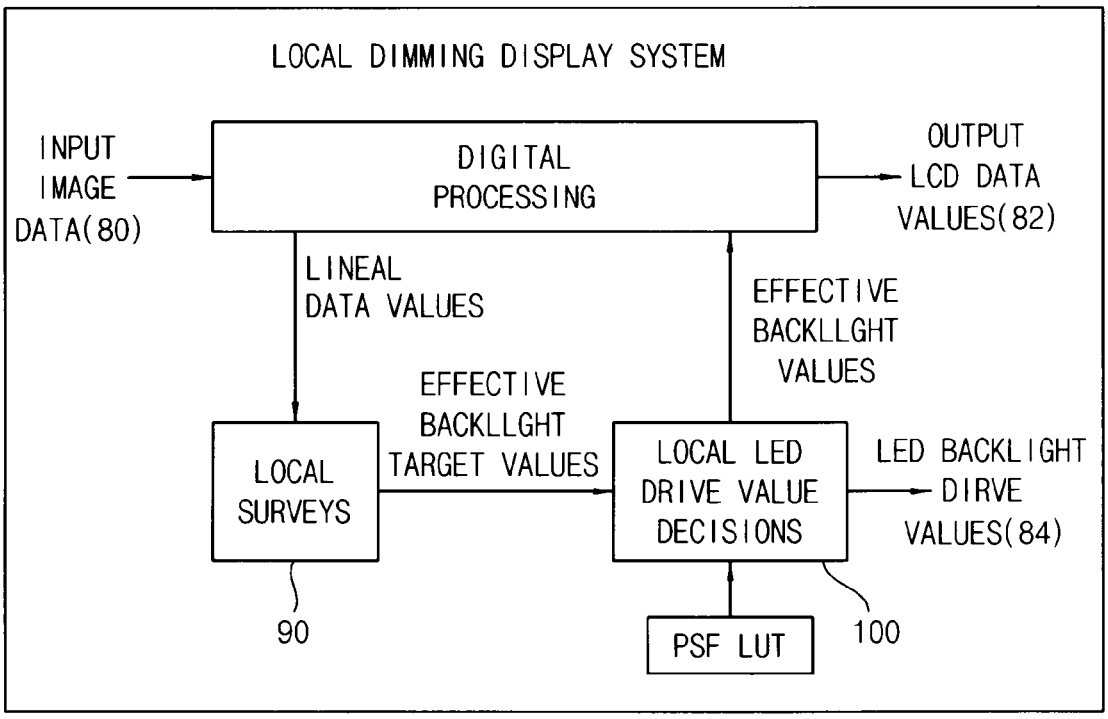
FIG. 4 illustrates a digital processing system for a display system implementing local dimming.

FIG. 4 illustrates a digital processing system for a display system implementing local dimming. Image data 80 is fed to the system and goes through two processes: 1) a process to output LCD data values 82 for the display panel 20, which is described in more detail below in reference to FIG. 8, and 2) a process to output backlight drive values 84 for the backlight 30. After the image data 80 is converted to linear data values, it goes through the survey block 90. As described above, the survey entails deriving the target illumination level (or need [i]) for each zone i based on the linear data values. The target value is then provided to the backlight decision block 100, which calculates Δ=need[i]−have[i] and determines whether to increment the backlight drive value for each zone "i" as described above in reference to FIG. 3.

As shown, the effective backlight values (i.e., the illumination levels) that are determined in the LED Drive Value Decision block 100 are fed back into the Digital Processing block. The Digital Processing block uses the backlight information to control the valve/shutter of the pixels in the display panel 20. The degree of brightness displayed by a pixel depends on both the illumination level of the backlight and how much of the light is transmitted through the valve/shutter of the pixels. For example, in the case of an LCD, the orientation of the liquid crystal molecules acts as the valve/shutter and determines the amount of light transmission. Hence, to achieve the same level of brightness, the display system 10 can use a high backlight illumination level and use the shutter/valve to let through a portion of it, or use a lower backlight illumination level and open the shutter/valve wider to let more of the backlight through. The Digital Processing block sets the shutter/valve to achieve the desired level of brightness in the ultimate image that is shown, taking into account the effective backlight values.

Figure 5:
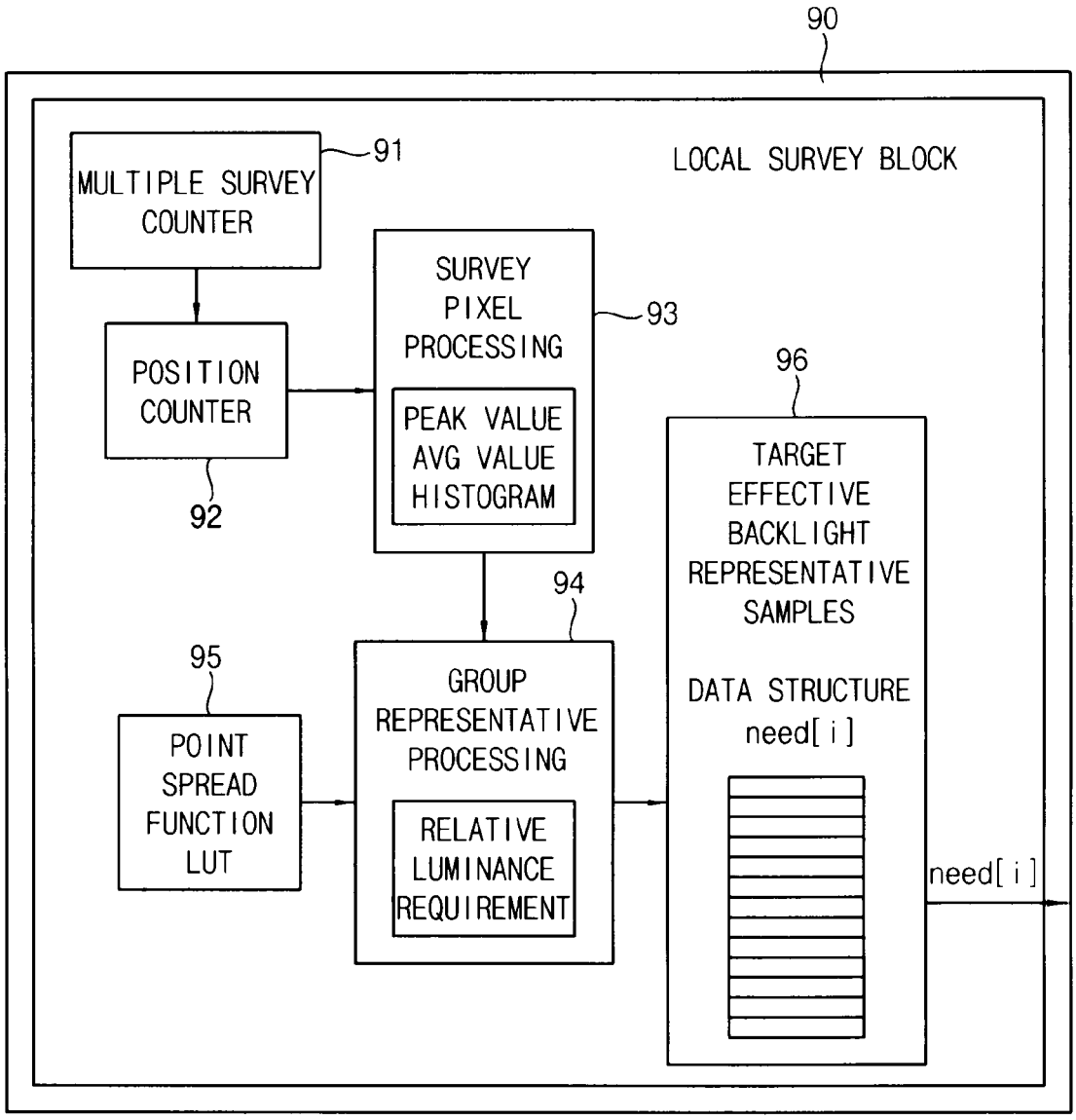
FIG. 5 is a schematic depiction of the survey block.

FIG. 5 is a schematic illustration of the survey block 90. As shown, a survey counter 91 and position counter 92 track which pixels are being accounted for in each zone. Then, Survey Pixel Processing block 93 surveys the pixels in a zone to determine the target illumination level (need[i]). Target illumination level can be set to a peak value (the luminance level requested by the most demanding pixel), an average value of the luminance levels requested by all the pixels in the zone), or a value derived using the histogram method disclosed in U.S. Patent Application Publication No. 2011/0025592. Then, Group Representative Processing block 94 scales each target that is set in the Survey Pixel Processing block 93 to see if any zone is being asked to provide an illumination level that it is not capable of providing. In making this determination, the data from the Position Counter 92 and a PSF LUT 95 are used because how much help a particular zone can get from its neighboring zones depends on its position. For example, a zone that is at or near a center of a backlight 30 has many neighbors that it can get help from. However, a zone that is at a corner of the backlight 30 may only have a few neighbors that can contribute to its illumination. Hence, the preliminary target value that is received from Survey Pixel Processing block 93 may be adjusted up for a zone that is at a corner, while it may be adjusted down for a zone near the center to produce what is herein referred to as the relative luminance requirement.

Using the relative luminance requirements, the Target Backlight Data Structure 96 for need[i] is populated. During this process, each zone may be further suvidivided into subdivisions to enhance the accuracy of the illumination adjustment. For example, with six zones, each zone can be divided into two subdivisions such that there will be twelve subdivisions (e.g., [i] would have [$i_1$] and [$i_2$]). The statistical data extracted from every subdivision constitutes a "survey." "Effective backlight," as used herein, is the illumination level.

Figure 6:
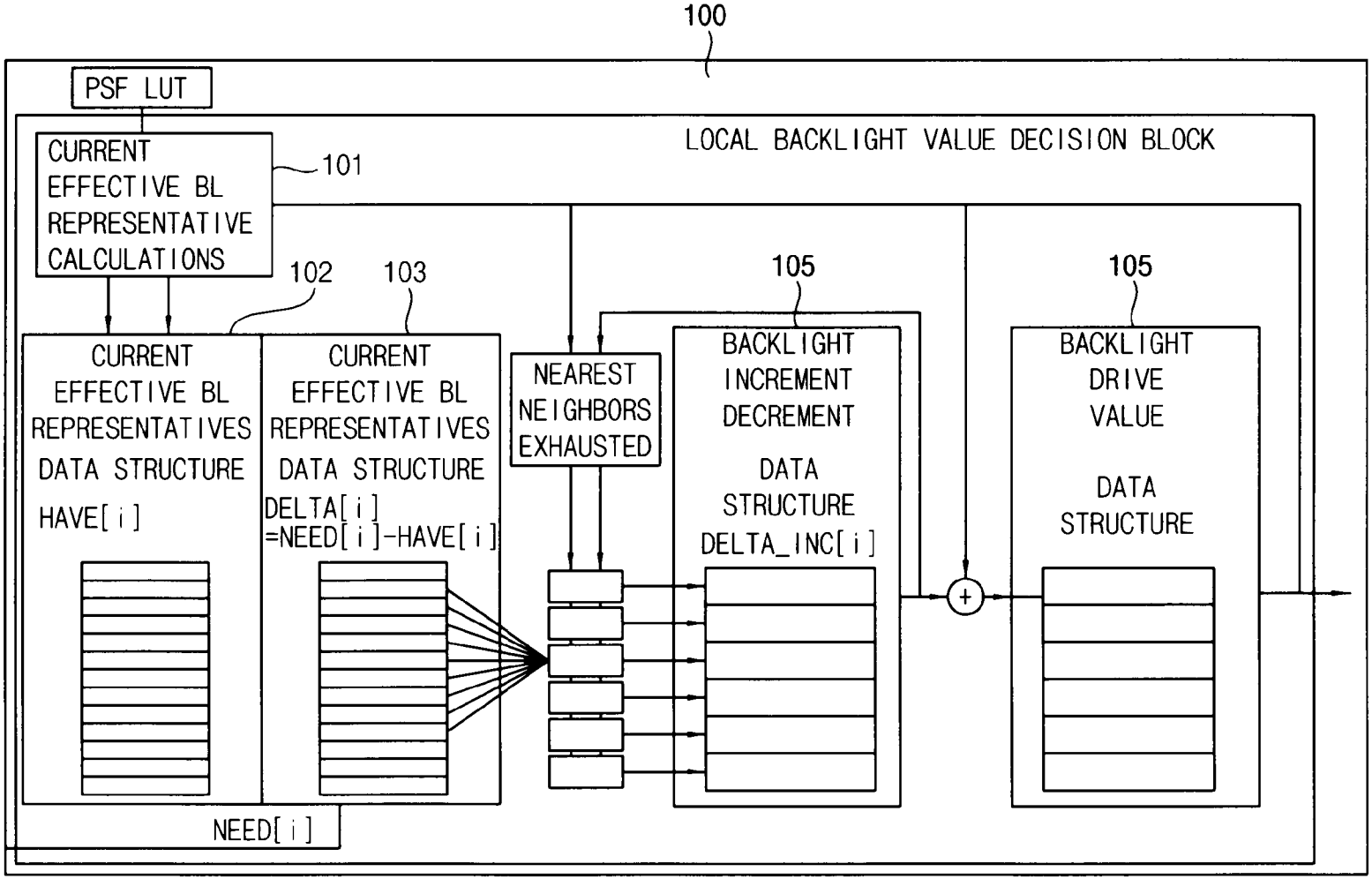
FIG. 6 is a schematic illustration of the backlight decision block.

FIG. 6 is a schematic illustration of the backlight decision block 100 shown in FIG. 4. As shown, a data structure 102 is populated with have[i] values for all the zones, wherein the have[i] values are received from an Effective Backlight Calculation block 101 that calculates the illumination level based on backlight drive values and PSF. A Delta Effective Backlight block 103 receives the need[i] values from the Target Backlight Data Structure 96 to calculate the Δ[i] values for all the subdivisions. The Δ[i] values are condensed back into six zones with neighbor contributions taken into account, in Neighbor Delta Logic block 104. Then, the increment amount for each zone is set in a Backlight Increment Data Structure 105. Using this data, a Backlight Drive Value Data Structure 106 is populated, so that a driving value is set for each zone i. In one embodiment, the backlight drive value decision block of FIG. 6 operates prior to the beginning of the next frame during the vertical back porch, or the dead time between frames.

Figure 7:
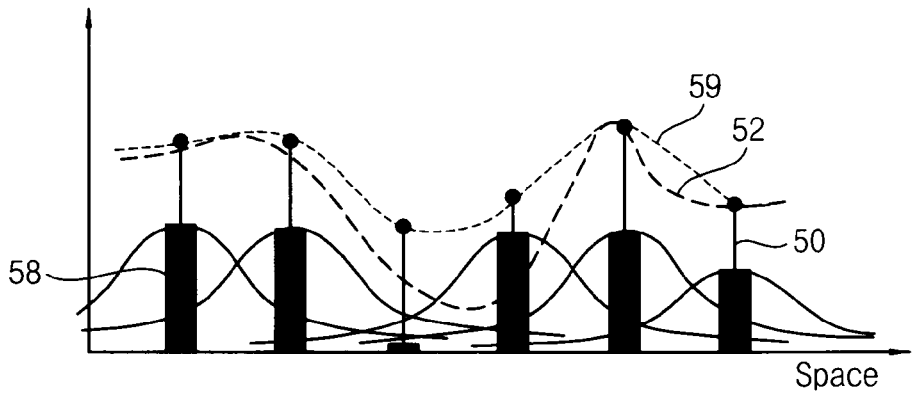
FIG. 7 illustrates an example of backlight drive values after the optimization process has been executed.

FIG. 7 illustrates an example of backlight drive values after the optimization process 60 has been executed. The figure shows optimized light source drive values 58 (shown by thick bars) in addition to the overall target illumination level 52 and the maximum channel values 50 (shown by thin bars) that were shown above in FIG. 2B. The optimized light source drive values 58 are lower than the maximum channel values 50. The optimized illumination level 59 is closer to the target illumination level 52 than the effective illumination level 40 that would have resulted by setting all the zones to the maximum channel values 50. FIG. 7 demonstrates that power savings can be achieved without compromising image quality, since the target illumination level 52 can be reached with lower drive values when neighbor contributions are taken into account.

EXAMPLE

A sample LUA Code for One-dimensional local dimming system is provided below. The survey block 90 divides the input image into subdivisions, the number of which is controlled by SUBDIV. The statistical data extracted from every subdivision is referred to as a "survey."

```
--Globals
lites = lites or 6                  --number of backlights
liteR = liteR or 511                --radius of the point spread function in logical pixels
liteD = liteD or 170                --spacing, number of logical pixels between lights
liteO = liteO or 117                --offset to the center of the first light
liteM = liteM or 440                --assumed maximum backlite sum from table (BFIX)
liteP = liteP or 75                 --percentage of backlight max to use (BPER
liteE = liteE or 0                  --use edge correction on backlight sum
minsp=20000                         --will contain min trough value of full-on backlight
maxsp=0                             --will contain max peak value of full-on backlight
GAMBITS=12
MAXCOL=(2^GAMBITS)-1                --maximum in gamut value
MAXOOG=(2^(GAMBITS+1))-1            --maximum OOG value
--SURVEY globals
SUBDIV = SUBDIV or 1 --subdivide value, let's set it to some power of 2
                     -- for simplicity ie. (2^0, 2^1, ...)
survey_width = math.floor(liteD/SUBDIV)      -- determined the width of the mini-survey
survey_anchor = liteO-liteD         --this scheme works when the starting point
                                    -- is anchored as a negative location
                                    --assumes that the offset will always be less than
                                    --the backlight spacing
num_surveys = ((lites+1) * SUBDIV) - 1
AVGP = 0.90
        ********************************************
        --********************************************
        --Survey the image:
        --Scan entire frame to survey input peak values and average values
        --and store a coarse array of local maxima
        --that will be used to calculate the NEEDed effective backlight (BL) coarse array
```

-continued

```
        --The survey is divided into mini-surveys
        --when landing on ceratin sample points (backlight centers and edges)
        --calculate maximum effective BL capacity at each sample point
        --Convert the peak values from the survey to NEEDed effective BL targets
        --based on the effective BL capacity values at each sample point
        --*****************************************
        --*****************************************
locmax={ }
locavg={ }
linemax={ }
glbmax = 0
maxbrite={ }
mbrite={ }
have={ }
need={ }
delta={ }
delta__neigh={ }
delta__inc={ }
  for i=0,num__surveys−1 do    --sample at each backlight center
                               --and at the midpoints between backlights ("edges" of zones)
    survey__start = survey__anchor + survey__width*(i+0.5)    --remember to keep a few extra bits
                                                              --of precision here
    survey__end = survey__anchor + survey__width*(i+1.5)
    if i==0 then
     survey__start = 0    --always start from the zero location on the first survey
    elseif i==num__surveys − 1 then
     survey__end = 1079    --always end with the last possible location on the last survey
    end
    locmax[i]=0
    locavg[i]=0
    maxbrite[i]=0
    mbrite[i] = 0
    need[i] = 0
    for y= math.floor(survey__start), math.ceil(survey__end) do
     linemax[y]=0
     for x=0,xsiz−1 do                                  --for every pixel on this scanline
            local r,g,b,w=spr.fetch(pipeline,x,y)       --fetch the image data
        linemax[y]=math.max(r,g,b,w,linemax[y])         --find the maximum pixel value
                                                        --in this line
        locavg[i]=locavg[i]+math.max(r,g,b,w)/xsiz/(survey__end−survey__start+1)
       end --for all pixels
      locmax[i] = math.max(linemax[y],locmax[i])    --note: we don't really need to save linemax[y]
      glbmax = math.max(linemax[y],glbmax)
      glbpow = glbmax/MAXOOG *100
      survey__center = math.floor(survey__anchor + survey__width*(i+1))
      if y==survey__center then
       maxbrite[i]=0
       for j=0,lites−1 do
          maxbrite[i]=maxbrite[i]+psf(y,j)       --sum up the full-on value
       end
  mbrite[i]=math.min(maxbrite[i],liteM)    --use fixe value, if it is big enough
AVG = AVG or 0
     if AVG == 0 then
      --CALCULATE NEED
      need[i]=math.floor(mbrite[i]*locmax[i]/MAXOOG)
     else
      --CALCULATE NEED
      need[i]=math.floor(mbrite[i]*math.max(AVGP*locmax[i],locavg[i])/MAXOOG)
     end
    end
  end
 end
```

Although the Example above is for a one-dimensional local dimming system, the optimization method provided herein may be adapted to two-dimensional systems. The optimization method may be used for backlight systems with white light sources or backlight systems having colored light sources (e.g., R, G, B or other primary).

Figure 8:
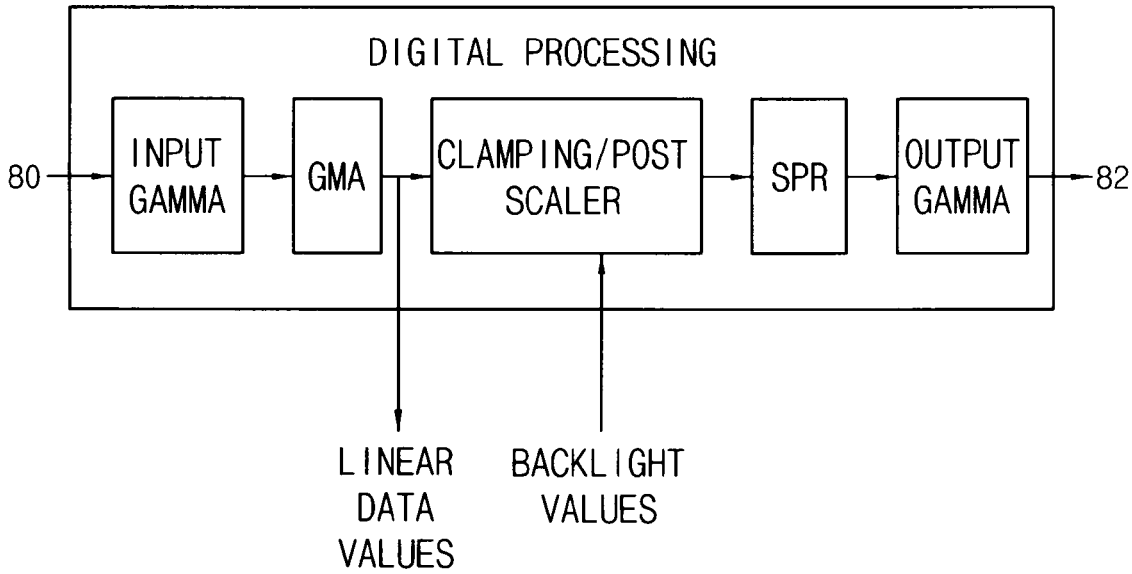
FIG. 8 is a schematic illustration of an exemplary embodiment of the Digital Processing block of FIG. 4.

FIG. 8 is a schematic illustration of an exemplary embodiment of the Digital Processing block of FIG. 4. The image data 80 (e.g., RGB input) is fed into an Input Gamma block 81 to get linearized. Usually, the linearization process uses an input gamma LUT. The input gamma block 81 may be omitted if the display is of the type that does not need a gamma conversion. Input gamma block 81 may also introduce some dithering on the input side of the data pathway. The output from the Input Gamma block 81 goes into a gamut mapping (GMA) block 83, which transforms the receive data specified as an RGB primary color set to a multi-primary set of colors. A "multi-primary" display uses four or more non-coincident color primaries (e.g., RGBW, RGBY, RGBC, RGBCW). There are well-known gamut-mapping techniques that may be used for the gamut mapping block 83. The gamut-mapped image data values produced by the gamut mapping block 83 may then be fed to a clamping block 85. The RGBW modified image data may contain out of gamut (OOG) colors whose red, green, or blue value may exceed the maximum allowable value. "Clamping" refers to a technique of forcing a value that is out of gamut back into an acceptable range. If, after gamut mapping, the R, G, B color values are out of gamut, the scaling/clamping block 85 clips the value to ensure that all final values are within gamut. Scaling/clamping is done carefully to cause minimum change to the hue. An exemplary clamping technique that may be used here is described in U.S. Pat. No. 7,893,944.

After clamping, the in-gamut values may enter a Sub-Pixel Rendering (SPR) block 86. If the display panel 20 contains a novel subpixel repeating group, such as what is described in U.S. Pat. Nos. 7,876,341, 7,701,476, or 7,583,279, subpixel rendering would be applied to convert the data to the particular subpixel layout. The data may then be processed in an optional output gamma block 87 before being output as backlight drive values 84.

Embodiments of the invention and all of the functional operations described in this specification can be implemented in digital electronic circuitry, or in computer software, firmware, or hardware, including the structures disclosed in this specification and their structural equivalents, or in combinations of one or more of them. Embodiments of the invention can be implemented as one or more computer program products, i.e., one or more modules of computer program instructions encoded on a computer-readable medium for execution by, or to control the operation of, data processing apparatus.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To display images, embodiments of the invention can be implemented on a computer that is connected to a display device, e.g., a CRT (cathode ray tube), OLED (organic light emitting diode), or LCD (liquid crystal display) monitor and an input device (e.g., keyboard and a pointing device, e.g., a mouse or a trackball). Other kinds of devices can be used to provide for interaction with a player as well; for example, feedback provided to the player can be any form of sensory feedback, e.g. visual feedback, auditory feedback, or tactile feedback; and input from the player can be received in any form, including acoustic, speech, brain waves, other physiological input, eye movements, gestures, body movements, or tactile input.

While this specification contains many specifics, these should not be construed as limitations on the scope of the invention or of what can be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the embodiments described above should not be understood as requiring such separation in all embodiments, and it should be understood that the described program components and systems can generally be integrated together in a single software product or packaged into multiple software products.

While the foregoing has been with reference to particular embodiments of the invention, it will be appreciated by those skilled in the art that changes in this embodiment may be made without departing from the principles and spirit of the invention.

What is claimed is:

1. A method of optimizing a luminance level of a backlight system, the method comprising:

dividing the backlight system into a plurality of zones including a first zone and at least one neighboring zone, each of the plurality of zones having a light source;

determining a target illumination level and a current illumination level for each of the plurality of zones based on data values of a display panel that is to be illuminated by the backlight system; and determining a difference between a target illumination level and a current illumination level for the first zone, incrementing a backlight drive value assigned to the first zone by an increment value, and iteratively checking for convergence of the target illumination levels and the current illumination levels in the plurality of zones until a predefined convergence condition is satisfied for the plurality of zones, wherein the increment value is dynamically adjusted based on the difference and contributions from the at least one neighboring zone for each iteration.

2. The method of claim 1, wherein the backlight drive value of a particular one of the zones is changed depending on backlight drive values in its neighboring zone.

3. The method of claim 1, wherein the incrementing is done according to a position of the zone in the backlight system.

4. The method of claim 1, further comprising dividing the zones into subdivisions, determining a target illumination level for each of the subdivisions, assigning a backlight drive value to each of the subdivisions, and calculating a difference between the target illumination level and a current illumination level resulting from the backlight drive value for each of the subdivisions.

5. The method of claim 1, wherein the incrementing comprises incrementing the backlight drive value of the first zone if one of the zones neighboring the first zone is at maximum backlight drive value and unable to achieve its target illumination level.

6. The method of claim 1, wherein the difference is calculated for each of the zones concurrently.

7. The method of claim 1, wherein the adjusting of the backlight drive value uses point spread function of each light source to determine a current illumination level.

8. A non-transitory computer-readable storage medium for causing a backlight system to optimize backlight drive values, the computer-readable storage medium containing executable instructions for:

dividing the backlight system into a plurality of zones including a first zone and at least one neighboring zone, each of the plurality of zones having a light source;

determining a target illumination level and a current illumination level for each of the plurality of zones based on data values of a display panel that is to be illuminated by the backlight system;

assigning a backlight drive value for the light source in each of the zones; and determining a difference between a target illumination level and a current illumination level for the first zone, incrementing the backlight drive value assigned to the first zone by an increment value, and iteratively checking for convergence of the target illumination levels and the current illumination levels in the plurality of zones until a predefined convergence condition is satisfied for the plurality of zones, wherein the increment value is dynamically adjusted based on the difference and contributions from the at least one neighboring zone for each iteration.

9. A display system comprising:

a display panel;

a backlight system illuminating the display panel, the backlight system being divided into a plurality of zones including a first zone and at least one neighboring zone and each of the plurality of zones having a light source;

a processor connected to the backlight system, the processor setting a backlight drive value of the light source in each of the zones by determining a difference between a target illumination level and a current illumination level for the first zone, incrementing a backlight drive value assigned to the first zone by an increment value, and iteratively checking for convergence of the target illumination levels and the current illumination levels in the plurality of zones until a predefined convergence condition is satisfied for the plurality of zones, wherein the increment value is dynamically adjusted based on the difference and contributions from the at least one neighboring zone for each iteration.

* * * * *